United States Patent [19]

Moranne

[11] 4,367,789

[45] Jan. 11, 1983

[54] INDUSTRIAL COOLING EXCHANGER USED FOR COOLING AIR OR OTHER GASES

[75] Inventor: Jean-Pierre Moranne, Franconville, France

[73] Assignee: Societe Anonyme des Usines Chausson, Asnieres, France

[21] Appl. No.: 94,881

[22] Filed: Nov. 16, 1979

[30] Foreign Application Priority Data

Nov. 20, 1978 [FR] France ..... 78 32646

[51] Int. Cl.[3] ..... F28F 7/00

[52] U.S. Cl. ..... 165/76; 165/79

[58] Field of Search ..... 165/76–83, 165/162, 140–145, 69

[56] References Cited

U.S. PATENT DOCUMENTS

| | | | |
|---|---|---|---|
| 1,660,163 | 2/1928 | Heaton | 165/83 |
| 1,875,142 | 8/1932 | Price | 165/78 |
| 2,512,748 | 6/1950 | Lucke | 165/83 |
| 3,216,732 | 11/1965 | Foust | 65/166 |
| 3,415,315 | 12/1968 | Donaldson et al. | 165/69 |
| 3,494,414 | 2/1970 | Warner | 165/82 |

*Primary Examiner*—William R. Cline
*Assistant Examiner*—Theophil W. Streule, Jr.
*Attorney, Agent, or Firm*—Browdy and Neimark

[57] ABSTRACT

An industrial cooling exchanger used for cooling air or another gas comprises an inlet collector and a return collector connected by heat exchanger elements dismountably assembled to said collectors by insertable parts. The collectors are floatingly mounted and a tight assembly between the collectors and the heat exchanger elements is provided by interposing therebetween at least one deformable gasket.

9 Claims, 5 Drawing Figures

INDUSTRIAL COOLING EXCHANGER USED FOR COOLING AIR OR OTHER GASES

The present invention relates to heat exchangers and in particular to cooling exchangers used for cooling gases.

The exchangers of this type are used particularly for cooling supercharged air in diesel engines.

The utilization of such apparatus gives rise to important problems taking in account the high temperatures to which the compressed air from a turbo-compressor is conducted at the inlet collector of the heat exchangers.

Actually, the differential heat expansions between the various portions of the heat exchanger are important, mainly when the apparatus is of a large size.

In order to take account of the differential heat expansions, it was necessary till now to provide heat expansion compensators made typically of intermediate parts provided between the collectors and the heat exchangers as such.

U.S. Pat. No. 2,512,748 has provided, in a tubular heat exchanger comprising an outer jacket, also of a tubular shape, a tube end plate mobile between resiliently deformable gaskets interposed between an outer cover and a ring shaped member which is part of the outer tubular jacket.

U.S. Pat. No. 2,202,493 has provided a particular arrangement for heat exchangers which have to support very high inner pressures. In this case, the ends of the tubes are engaged in a tube end plate covered by a box which is tightened on the periphery of the tube end plate via a gasket. For tightening the plate, the patent proposes to use screws which are engaged into an upper plate, which in turn is connected below the tube end plate comprising the tubes via annular half-flanges. The whole assembly as hereabove described is mounted inside a bell-shaped cover and may therefore freely slide.

U.S. Pat. No. 1,780,837 discloses a tubular plate in which are engaged tube ends, said tubular plate forming at the periphery thereof a socket which can slide inside a jacket. A deformable gasket is interposed between the jacket and the socket.

In all the hereabove mentioned known embodiments, it is necessary in order to have access to the tubes of the heat exchanger core to disassemble the whole apparatus and extract the heat exchanger core by sliding it axially inside a jacket.

The present invention relates to a new arrangement of an industrial cooling exchanger.

The present invention enables one to make an apparatus in which heat exchanger cores can be connected directly to the collectors and are dismountable by displacing them transversaly over a length corresponding to their thickness.

According to the invention, the industrial cooling exchangers used for cooling air or another gas and comprising an inlet collector and a return collector connected by heat exchanger elements dismountably assembled onto said collectors by parts to be inserted, is characterized in that the collectors are floatingly mounted and in that the tight assembly between the collectors and the heat exchanging elements is carried out by interposing therebetween at least one deformable gasket.

Various further features of the invention will become more apparent from the following detailed description.

An embodiment of the invention is shown as a non limitative example in the accompanying drawings, in which.

Figure 1:
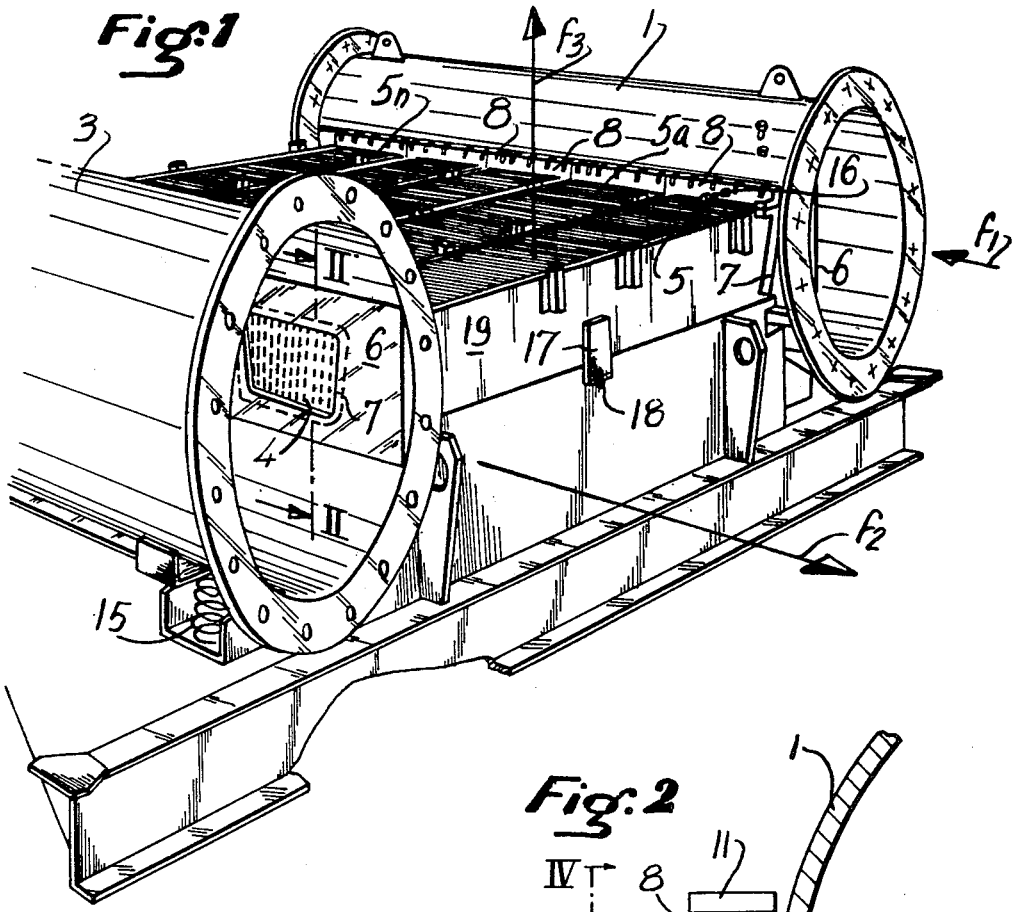
FIG. 1 is a partial perspective and partly diagrammatic view of a cooling exchanger carrying the invention into practice.

Referring now to the drawings, FIG. 1 shows in part a cooling exchanger of the type of those which are used for instance for cooling supercharged air of diesel engines.

The heat exchanger comprises an inlet collector 1 supplied with hot compressed air along arrow $f_1$. Symmetrically, the heat exchanger comprises a return collector 3 directing the cooled air along arrow $f_2$ towards the receiving apparatus, such as the admission means of a diesel engine.

Hot compressed air flows into the collector 1 through tubes 4 of a plurality of heat exchanger cores 5, 5*a*, . . . 5*n*, which are arranged between the collectors 1 and 3, and is cooled. The heat exchanger cores 5-5*n* are in a manner known per se provided with fins or other cooling dissipators which are connected to the tubes 4 outside of the tubes, and air is pulsed through the cores in the direction of the arrow $f_3$ by means of a blower (not shown).

Figure 4:
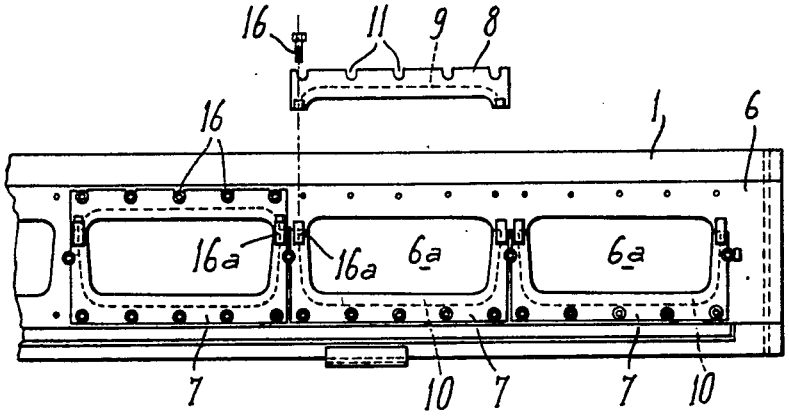
FIG. 4 is a narrowed partial elevation view along line IV—IV of FIG. 2.

The collectors 1 and 3 may be of a general cylindrical shape as shown, but according to the invention the portion of said collectors which is adjacent the ends of the cores 5-5*n* are formed with a flat portion 6 with apertures 6*a*. The collectors 1 and 3 support on their flat portion 6, on the outer side thereof, U-shaped cradles 7 of a trapezoidal shape, as shown in FIGS. 1 and 4, the smaller base of which is at the bottom. The cradles 7 are added onto the flat portion 6 by suitable means, for instance bolts, welds or other means.

Figure 2:
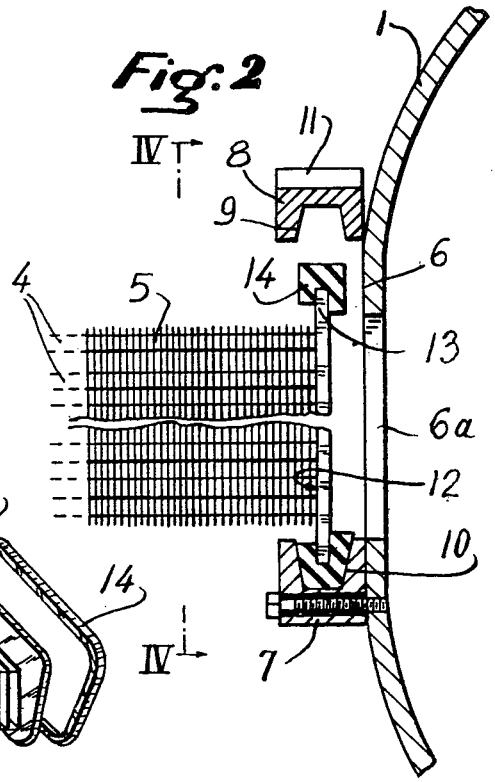
FIG. 2 is an enlarged diagrammatic cross-sectional view seen substantially along line II—II of FIG. 1.

The upper portion of each cradle is open, which means that the larger base of the trapezoid comprises a cover 8, shown in FIGS. 2 and 4 in a lifted condition. The cover 8 as well as the corresponding cradle 7 are formed, from their inner walls, with a respective groove 9, 10 the cross-section of which is also preferably of a trapezoidal shape.

In addition, each cover 8 is formed in its top with transverse grooves 11 or holes for engaging securing screws 16 (FIG. 4).

Figure 3:
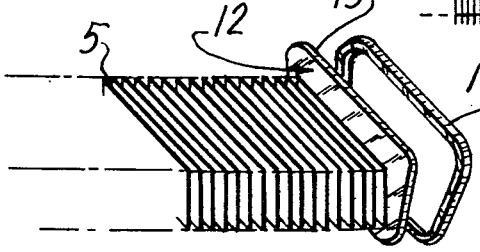
FIG. 3 is a perspective view illustrating diagrammatically two of the members shown in FIG. 2.

The ends of each core 5, 5*a*, . . . 5*n* are provided with tube end plates 12, in the openings of which are engaged the tubes 4. The tube end plates 12 protrude around the core so as to form a flange 13 and, as shown clearly in FIGS. 1 and 3, the tube end plates are also trapezoidal in shape.

The flange 13 which protrudes around the core is intended for receiving a gasket 14 made of a flowable deformable plastics material, preferably tetrafluoroethylene, although some elastomers may also be used. The gasket 14 is provided, as shown in FIG. 2, for fitting onto the whole periphery of the flange 13.

When mounting the heat exchanger, one starts by fitting the collectors 1 and 3 which are mounted on swivels, springs, rolls or similar members 15 (FIG. 1), then one fits the successive cores 5, 5*a*, . . . 5*n* by inserting the gaskets 14 of the tube end plates 12 inside the grooves 10 of the cradles 7.

Due to the weight of the cores and the trapezoidal shape of the groove 10 of the cradles 7, the deformable plastic gasket 14, fills up the cradle groove space so that an excellent tightness is ensured. Finally, the covers 8 are put in position and tightened on the upper edge of the gasket 14, and screws or other locking members 16 are passed in the grooves and/or holes 11 of the covers in order to be screwed into the flat portions 6 of the collectors 1, 3 and in sockets 16*a*.

In addition, it is advantageous to have the cores supported in the vicinity of their medium portion by centering lugs 17 bearing against supports 18. The lugs 17 are for instance fixed on side flanges 19 of the cores. Other support means may be provided, but the lugs 17 are preferably retained as centering and holding means during the movements which may be caused by the heat expansions and shrinkages to which the heat exchanger is subjected.

As is apparent from the foregoing, the cores are thus supported independently of the collectors and are connected thereto only through very deformable gaskets so that the differential heat expansions which may exist are easily compensated, on the one hand by the very deformable gaskets 14 and on the other hand by the fact of mounting the collectors on swivels 15 or similar members, the cores being in turn substantially supported in their medium portion by the lugs 17.

Figure 5:
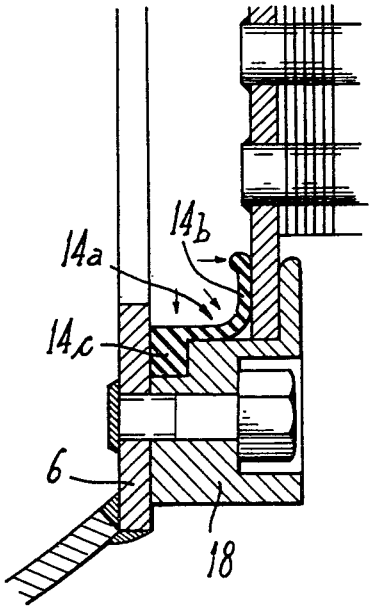
FIG. 5 is a partial cross-sectional view similar to FIG. 2 of a variant embodiment of the invention.

The flowable gaskets as hereinabove described can be substituted in the disclosed cooling exchanger by employing deformable gaskets 14*a* (FIG. 5) comprising a soft lip 14*b* and a heel 14*c*. The heel 14*c* is tightened between a flange 18 and the flat portion 6, while the lip 14*b* is applied on the flange 13 through the pressure of the fluid circulating in the heat exchanger.

The invention is not limited to the embodiments shown and described in detail, and many modifications thereof may be carried out without departing from the scope of the invention as shown in the appended claims.

I claim:

1. An industrial cooling exchanger for cooling air or other gases comprising an inlet collector and a return outlet collector spaced from each other, support means, means for floatingly mounting said inlet and outlet collectors on said support means, a plurality of heat exchanger elements interconnecting said inlet and outlet collectors and aligned with each other, means including insertable parts for dismountably assembling each of said heat exchangers onto said inlet and outlet collectors, said insertable parts comprising at least one deformable gasket interposed between said inlet and outlet collectors and each end of said heat exchanger elements, each of said inlet and outlet collectors comprising a plurality of openable cradles aligned with each other on each collector and of substantially U-shaped form, said plurality of cradles including one cradle for each end of each of said heat exchanger elements, means to mount all of said cradles on the outsides of said inlet and outlet collectors, each of said cradles having an upper portion and a groove for receiving the deformable gasket to be engaged therein; each of the heat exchanger elements comprising, at each of the two ends thereof, a heat exchanger tube end plate engaging said deformable gasket in sealed relationship therewith, and a plurality of grooved covers one for each of said cradles for engaging said deformable gasket in sealed relationship therewith for selectively closing said upper portion of said cradle to thereby mount said heat exchanger element in operative relation to said collectors; whereby each of said heat exchanger elements can be removed from said cradles on said inlet and outlet collectors without disturbing said collectors on said support means after removal of said grooved covers from the two cradles at the inlet and outlet collector ends of an individual heat exchanger element.

2. An exchanger according to claim 1, wherein the heat exchanger elements comprise independent heat exchanger cores.

3. An exchanger according to claim 1, wherein the means for floatingly mounting the collectors comprises spring means interposed between said collectors and said support means.

4. An exchanger according to claim 1, wherein the at least one deformable gasket comprises a deformable sealing lip.

5. An exchanger according to claim 1, wherein each of the U-shaped cradles has substantially the shape of a trapezoid, the smaller base of which is placed at the bottom and the larger base of which is formed by the cover.

6. An exchanger according to claim 1, wherein the groove of each of the cradles and of the cover closing it has a substantially trapezoidal shape.

7. An exchanger according to claim 1, wherein the tube end plate mounted at each end of a core has also the shape of a trapezoid and forms a flange around the core, each flange being partly at least imbedded in the deformable gasket.

8. An exchanger according to claim 1, wherein the cradles are added onto a flat portion of the collectors.

9. An exchanger according to claim 2, wherein the cores comprise holding lugs adjacent the middle portion thereof.

* * * * *